US010010756B2

(12) United States Patent
Watterson

(10) Patent No.: US 10,010,756 B2
(45) Date of Patent: Jul. 3, 2018

(54) FRICTION REDUCING ASSEMBLY IN AN EXERCISE MACHINE

(71) Applicant: ICON Health & Fitness, Inc., Logan, UT (US)

(72) Inventor: Eric S. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 15/844,321

(22) Filed: Dec. 15, 2017

(65) Prior Publication Data

US 2018/0104543 A1 Apr. 19, 2018

Related U.S. Application Data

(63) Continuation-in-part of application No. 14/997,075, filed on Jan. 15, 2016.
(Continued)

(51) Int. Cl.

| | |
|---|---|
| ***A63B 24/00*** | (2006.01) |
| ***A63B 21/005*** | (2006.01) |
| *A63B 21/22* | (2006.01) |
| *A63B 22/02* | (2006.01) |
| *A63B 22/00* | (2006.01) |

(Continued)

(52) U.S. Cl.
CPC ..... *A63B 24/0087* (2013.01); *A63B 21/0058* (2013.01); *A63B 22/001* (2013.01); *A63B 21/225* (2013.01); *A63B 22/0023* (2013.01); *A63B 22/0076* (2013.01); *A63B 22/025* (2015.10); *A63B 22/04* (2013.01); *A63B 22/0605* (2013.01); *A63B 22/0664* (2013.01); *A63B 24/0075* (2013.01); *A63B 71/0622* (2013.01); *A63B 71/0686* (2013.01); *A63B 2071/0625* (2013.01); *A63B 2071/0638* (2013.01); *A63B 2071/0691* (2013.01); *A63B 2209/00* (2013.01); *A63B 2209/08* (2013.01); *A63B 2225/30* (2013.01)

(58) Field of Classification Search
CPC . A63B 24/00; A63B 24/0062; A63B 24/0087; A63B 22/02; A63B 22/0015; A63B 22/0023; A63B 22/0235; A63B 22/0664; A63B 22/0605; A63B 22/203; A63B 22/0214; A63B 22/0228; A63B 21/0051; A63B 2071/0063; A63B 71/0054; A63B 2022/0676; A63B 2225/30
See application file for complete search history.

(56) References Cited

U.S. PATENT DOCUMENTS 9,114,276 B2 * 8/2015 Bayerlein ..... A63B 21/0053
9,162,106 B1 * 10/2015 Scheiman ..... A63B 23/08
(Continued)

*Primary Examiner* — Glenn Richman
(74) *Attorney, Agent, or Firm* — Ray Quinney & Nebeker

(57) ABSTRACT

An exercise machine includes a frame and a movable element movably attached to the frame that is movable in a performance of an exercise. The exercise machine also includes a friction reducing assembly with a first part attached to the movable element and a second part attached elsewhere on the exercise machine. The friction reducing assembly includes a non-ferromagnetic material and a magnet that moves relative to the non-ferromagnetic material as the movable element moves. The relative movement of the non-ferromagnetic material and the magnet generate a force that reduces friction between the non-ferromagnetic material and the magnet.

20 Claims, 11 Drawing Sheets

Related U.S. Application Data

(60) Provisional application No. 62/104,156, filed on Jan. 16, 2015.

(51) Int. Cl.

| | |
|---|---|
| *A63B 22/06* | (2006.01) |
| *A63B 22/04* | (2006.01) |
| *A63B 71/06* | (2006.01) |

(56) References Cited

U.S. PATENT DOCUMENTS

| | | | | |
|---|---|---|---|---|
| 9,827,458 | B2 * | 11/2017 | Dalton | A63B 21/055 |
| 2015/0352402 | A1 * | 12/2015 | Arnold | A63B 23/03591 482/57 |

* cited by examiner

FRICTION REDUCING ASSEMBLY IN AN EXERCISE MACHINE

RELATED APPLICATIONS

This application is a continuation-in-part of U.S. patent application Ser. No. 14/997,075, filed 15 Jan. 2016, entitled "Cushioning Mechanism in an Exercise Machine," which is incorporated herein by reference in its entirety, and which claims priority to and the benefit of U.S. Provisional Patent Application No. 61/104,156, filed 16 Jan. 2015, entitled "Cushioning Mechanism in an Exercise Machine," which application is also incorporated herein by reference in its entirety.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling, among other activities. In contrast, anaerobic exercise often involves high intensity exercises over a short duration of time. Popular forms of anaerobic exercise include strength training and short distance running.

Many people choose to perform aerobic exercises indoors, such as in a gym or their home. Often, a user engages an aerobic exercise machine to perform an aerobic workout indoors. One such type of an aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes, to name a few.

One type of exercise device is disclosed in U.S. Patent Publication No. 2003/0148853 issued to Nerio Alessandri, et al. In this reference, a physical exercise apparatus for recreational, rehabilitative, gymnastic, or sports purposes includes at least one mobile part and at least one support part, interacting by means of field forces generated by magnetic fields inserted between relative parts of which the apparatus is made. Another type of device using magnetic fields is disclosed in U.S. Patent publication No. 2014/0265690 issued to Gregory D. Henderson. Both of these references are herein incorporated by reference for all that they contain.

SUMMARY

In one embodiment, an exercise machine includes a frame and a movable element movably attached to the frame that is movable in a performance of an exercise. The exercise machine also includes a friction reducing assembly with a first part attached to the movable element and a second part attached elsewhere on the exercise machine. The friction reducing assembly includes a non-ferromagnetic material and a magnet that moves relative to the non-ferromagnetic material as the movable element moves. The relative movement of the non-ferromagnetic material and the magnet generate a force that reduces friction between the non-ferromagnetic material and the magnet during operation of the apparatus.

The non-ferromagnetic material may create a secondary magnetic field when the magnet moves relative to the non-ferromagnetic material.

The movable element may include a foot beam and a foot pedal connected to the foot beam.

The foot beam may include the non-ferromagnetic material.

The second part of the friction reducing assembly can be integrated into the foot beam.

The exercise machine may further include a head of a crank arm slidably attached to an underside of the foot beam.

The foot beam can move relative to the head of the crank arm when the foot beam is moving in a reciprocating motion.

The exercise machine may further include a rail attached to the underside of the foot beam.

The exercise machine may further include a deceleration mechanism attached to an end of the underside of the foot beam that causes the head of the crank arm to decelerate when the head slidably approaches the end.

The head of the crank arm can be in communication with an electric power source.

The head of the crank arm can be in communication with the electric power source through a rotary pivot.

The exercise machine may further include a rotor that holds the magnet.

The exercise machine may further include a face of the magnet that is exposed in the rotor.

The exercise machine may further include a processor and memory.

The memory may include programmed instructions to cause the processor to generate a weight value representative of a user.

The programmed instructions may further cause the processor to rotate the rotor at a speed based at least in part on the weight value.

In another embodiment, an exercise machine includes a friction reducing assembly including a non-ferromagnetic material.

The friction reducing assembly may include a magnet that moves relative to the non-ferromagnetic material.

The friction reducing assembly may include a rotor.

The magnet can be incorporated into the rotor which causes the magnet to move as the rotor rotates.

The friction reducing assembly may include a processor and memory.

The memory may include programmed instructions to cause the processor to generate a weight value representative of a user.

The programmed instructions cause the processor to rotate the rotor at a speed based at least in part on the weight value.

The relative movement of the non-ferromagnetic material and the magnet generate a magnetic force that reduces friction between the non-ferromagnetic material and the magnet.

The exercise machine may further include a foot beam.

The exercise machine may further include a foot pedal connected to the foot beam.

The foot beam can include the non-ferromagnetic material.

The exercise machine may further include a crank arm.

The exercise machine can further include a rotary joint between the foot beam and the crank arm.

The foot beam is in communication with an electric power source through the rotary joint.

The exercise machine may further include a head of a crank arm slidably attached to an underside of the foot beam.

The foot beam can move relative to the head of the crank arm when the foot beam is moving in a reciprocating motion.

The exercise machine includes a deceleration mechanism attached to an end of the underside of the foot beam that causes the head of the crank arm to decelerate as the head slidably approaches the end of the underside.

An exercise machine can also include a frame.

The exercise machine may further include a foot beam movably attached to the frame that is movable in a performance of an exercise.

The exercise machine may further include a friction reducing assembly.

The friction reducing assembly may include a non-ferromagnetic material incorporated into the foot beam.

The friction reducing assembly may include a crank arm in slidable contact with an underside of the foot beam.

The friction reducing assembly may include a rotor with at least one magnet incorporated to a head of the crank arm and causes with magnet to move with respect to the underside as the rotor rotates.

The friction reducing assembly may include a rail attached to the underside of the foot beam.

The friction reducing assembly may include a deceleration mechanism attached to an end of the underside of the foot beam that causes the head of the crank arm to magnetically decelerate as the head slidably approaches the end.

The foot beam may be in communication with an electric power source through a pivot joint.

The friction reducing assembly may include a processor and memory.

The memory may include programmed instructions to cause to the processor to generate a weight value representative of a user.

The memory may also include programmed instructions configured to cause the processor to rotate the rotor at a speed based at least in part on the weight value.

The relative movement of the non-ferromagnetic material and the magnet may generate a force that reduces friction between the non-ferromagnetic material and the magnet. This and any other of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
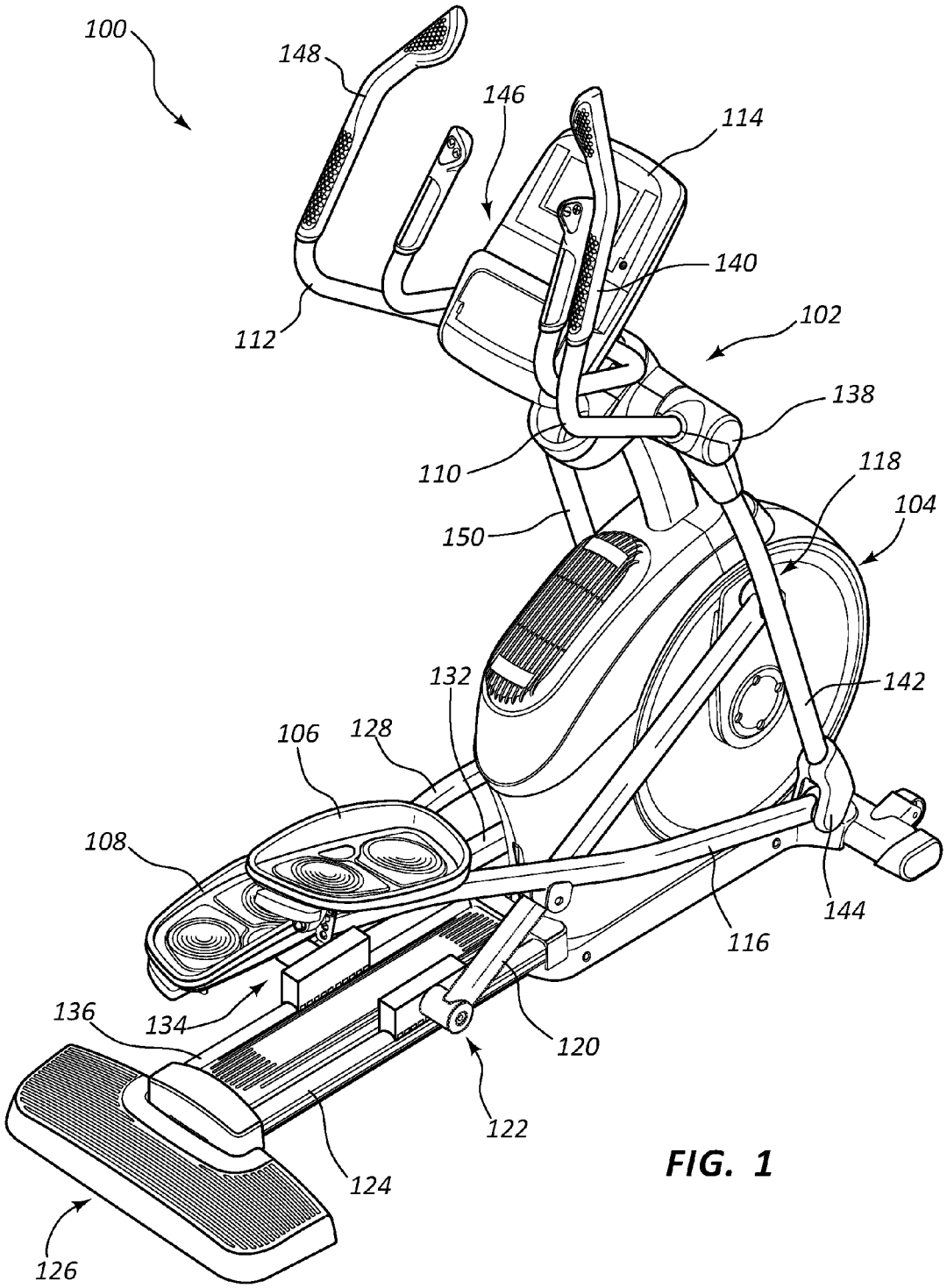
FIG. 1 illustrates a perspective view of an example of an exercise machine in accordance with the present disclosure.

With reference to the figures, FIG. 1 depicts an example of an exercise machine 100, such as an elliptical machine. The exercise machine 100 includes a frame 102, a resistance mechanism 104, a right foot pedal 106, a left foot pedal 108, a right arm lever 110, a left arm lever 112, and a console 114. The right foot pedal 106 is linked to the right arm lever 110. Likewise, the left foot pedal 108 is linked to the left arm lever 112. Each of foot pedals 106, 108 and arm levers 110, 112 move along reciprocating paths with each other. Further, each of foot pedals 106, 108 and arm levers 110, 112 are movably attached to the resistance mechanism 104 to resist the movement of the arm levers 110, 112 and the foot pedals 106, 108 along the reciprocating paths.

In the illustrated example, the right foot pedal 106 is attached to a right foot beam 116, which connects the right foot pedal 106 to the right arm lever 110. A right linkage 120 connects the right foot beam 116 to the resistance mechanism 104 at a right resistance end 118. The right linkage 120 also comprises a right track end 122 that is guided by a right track 124 of a base portion 126 of the frame 102.

Likewise, the left foot pedal 108 is attached to a left foot beam 128, which connects the left foot pedal 108 to the left arm lever 112. A left linkage 132 connects the left foot beam 128 to the resistance mechanism 104. The left linkage 132 also comprises a left track end 134 that is guided by a left track 136 of the base portion 126 of the frame 102.

The right arm lever 110 is attached to the frame 102 at a right pivot connection 138. The right arm lever 110 comprises a right handle section 140 positioned above the right pivot connection 138 when the exercise machine 100 is oriented in an upright position. Further, the right arm lever 110 includes a right linkage section 142 that is positioned below the right pivot connection 138 when the exercise machine 100 is oriented in the upright position. The right linkage section 142 connects to the right foot beam 116 at a right joint 144. Thus, as the resistance mechanism 104 rotates, the right foot pedal 106 and right arm lever 110 move along the reciprocating paths.

Likewise, the left arm lever 112 is attached to the frame 102 at a left pivot connection 146. The left arm lever 112 comprises a left handle section 148 positioned above the left pivot connection 146 when the exercise machine 100 is oriented in an upright position. Further, the left arm lever 112 includes a left linkage section 150 that is positioned below the left pivot connection 146 when the exercise machine 100 is oriented in the upright position. The left linkage section 150 connects to the left foot beam 128 at a left joint. Thus, as the resistance mechanism 104 rotates, the left foot pedal 108 and left arm lever 112 move along the reciprocating paths.

The console 114 may contain a display and controls. The controls may allow the user to specify a resistance level to be applied by the resistance mechanism 104. In some examples, the controls may also be used to control other operating parameters of the exercise machine, such as incline, side to side tilt, speaker volume, programmed exercise routines, other parameters, or combinations thereof. The display may show selected parameters to the user. Additionally, the display may be capable of presenting the user's physiological parameters, timers, clocks, scenery, routes, other types of information, or combinations thereof.

The right and left tracks 124, 136 guide the right and left track ends 122, 134, respectively. The right and left track ends 122, 134 support the weight of the user as the user stands on the foot pedals 106, 108. As the user moves his or her feet with the rotation of the resistance mechanism 104, the right track end 122 moves along the right track 124 and the left track end 134 moves along the left track 136. The connection between the right and left track ends 122, 134 and the right and left tracks 124, 136 is a reduced friction connection when the right and left track ends 122, 134 are moving. In some examples, the reduced friction connection is a non-contact connection. The movement between the track ends 122, 134 and the tracks 124, 136 may create a magnetic force that applies a force to separate the track ends 122, 134 from the tracks 124, 136. However, such a force may not be sufficient to make the connection between the track ends 122, 134 and the tracks 124, 136 non-contact connections. In some examples, the magnetic force merely reduced the friction between the track ends 122, 134 and the tracks 124, 136 while still maintaining contact. In other examples, the magnetic force is sufficient to cause a physical separation between the track ends 122, 134 and the tracks 124, 136. However, when the track ends 122, 134 and the tracks 124, 136 are static with respect to each other, there is not sufficient magnetic force generated to prevent physical contact between the track ends 122, 134 and the tracks 124, 136. The interaction between the tracks 124, 136 and the track ends 122, 134 will be described in more detail in conjunction with FIGS. 2A and 2B.

Figure 2A:
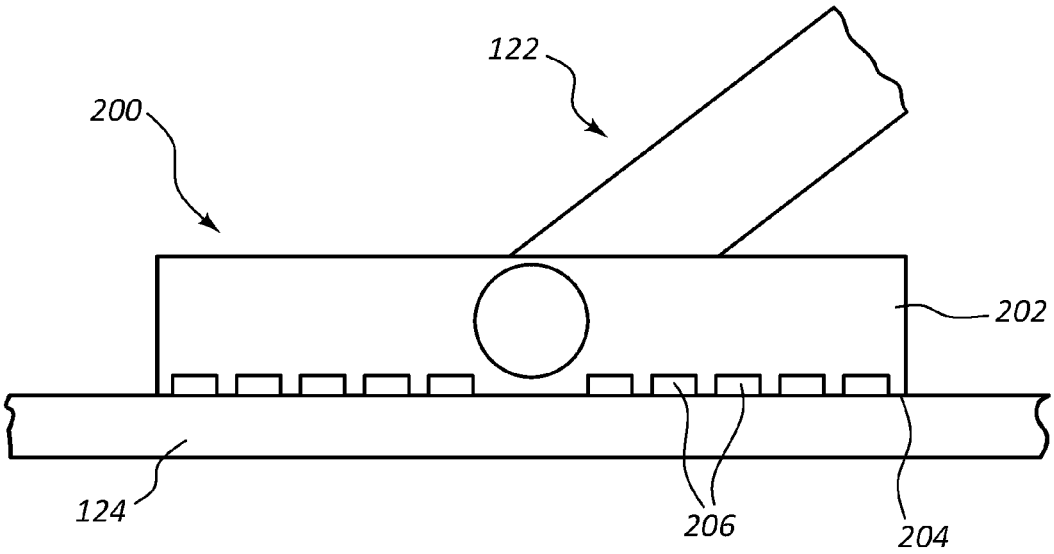
FIG. 2A illustrates a side view of an example of a friction reducing assembly integrated into the exercise machine in accordance with the present disclosure.
Figure 2B:
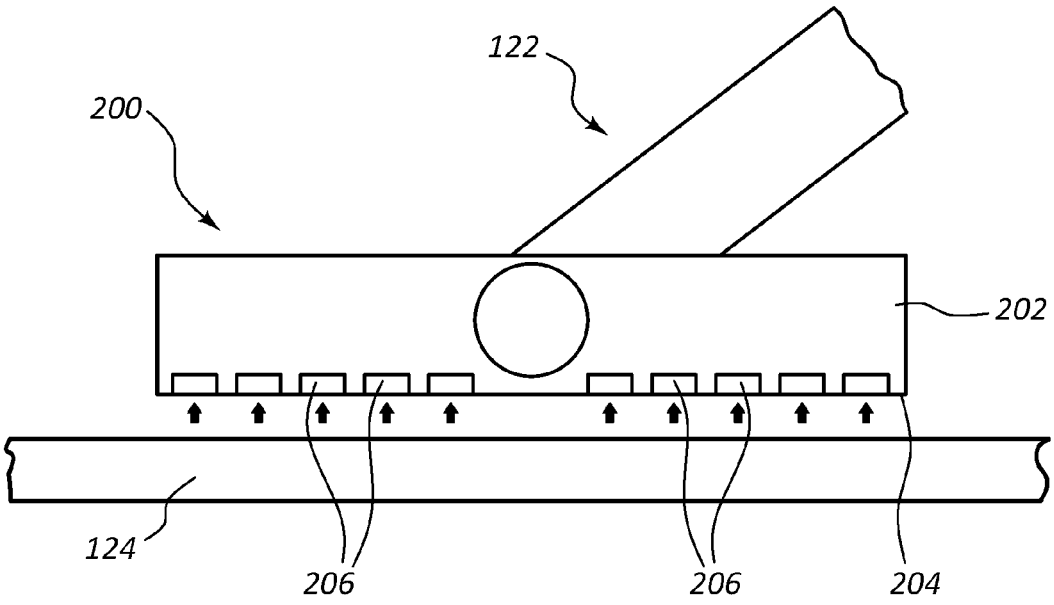
FIG. 2B illustrates a side view of an example of a friction reducing assembly integrated into the exercise machine in accordance with the present disclosure.

FIGS. 2A and 2B depict an example of a friction reducing assembly integrated into the exercise machine 100 at the right track 124 and the right track end 122 of the right linkage 120. While the friction reducing assembly of FIGS. 2A and 2B are described herein as being integrated into the exercise machine of FIG. 1, the examples in FIGS. 2A and 2B can be integrated into other models and types of exercise machines 100. In the illustrated example, there is no movement between the right track 124 and the right track end 122. The magnetic unit 200 is pivotally attached to the right track end 122. The magnetic unit 200 comprises a housing 202 with an underside 204 facing the track 124. In this example, multiple magnets 206 are embedded in the underside 204 such that the magnets 206 collectively create a magnetic field that is directed towards the track 124.

In some examples, each of the magnets individually directs a magnetic field towards the track. In other examples, at least some of the magnets are oriented to direct their individual magnetic fields in ways that augment the collective magnetic field. For example, the magnets may be arranged to achieve a Halbach effect. In such an arrangement, a first magnet is positioned to direct its magnetic field towards the track, and adjacent magnets positioned on either side of the first magnet may be oriented to direct their magnetic fields towards the first magnet. Such an arrangement may exhibit a collective magnetic field that projects farther into the track than if each of the magnets individually directed their magnetic fields towards the track.

Further, in the illustrated example, the track 124 is made of a non-ferromagnetic material. A non-exhaustive list of non-ferromagnetic materials may include aluminum, copper, silver, lead, magnesium, platinum, tungsten, alloys of otherwise magnetic materials, mixtures thereof, alloys thereof, composites thereof, other materials, or combinations thereof. In some cases, the non-ferromagnetic material produces no magnetic field or just a weak magnetic field. However, the non-ferromagnetic material may be electrically conductive such that when the non-ferromagnetic material is exposed to a moving magnetic field, an electrical current is generated in the non-ferromagnetic material. Such electrical current may cause a secondary magnetic field to be generated as described according to Lenz Law. Such a secondary magnetic field may oppose individual or collective magnetic fields generated by the magnets 206 in the magnetic units 200. Thus, the secondary magnetic field may apply a magnetic force that repels the magnetic unit 200. The characteristics of such a magnetic force from the non-ferromagnetic material may be dependent on the volume of non-ferromagnetic material, the electrical conductivity of the non-ferromagnetic material, the strength of the magnetic field from the magnets 206 in the magnetic unit 200, the spacing of the magnets 206 in the housing's underside 204, the orientation of the magnets 206 in the housing's underside 204, the speed of the relative movement between the track 124 and the track end 122, other factors, or combinations thereof.

In some examples, the characteristics of the magnetic unit 200 and the track 124 are such that the secondary magnetic field is strong enough to repel the magnetic unit 200 such that the track end 122 is levitated off of the track 124 when the track end 122 is moving along the track 124. An example of the track end 122 being levitated off of the track 124 is depicted in FIG. 2B. In those circumstances where the track end 122 is levitated off of the track 124, minimal physical friction between the track 124 and the track end 122 exist. Such minimal friction reduces wear and tear from movement between the track 124 and the track end 122. In other situations, the secondary magnetic field is not sufficient to cause the track end 122 to levitate off of the track 124, but the secondary magnetic field can be sufficient to reduce the weight bearing load on the track 124. In such a circumstance, the reduced load reduces the friction between the track end 122 and the track 124, thereby prolonging the useful life of the track end 122 and the track 124 based on reduced wear and tear.

Further, the magnetic fields from the magnetic unit 200 and the non-ferromagnetic material may absorb variations in the forces applied to the non-contact connection based on the movements of the user. For example, in circumstances where the user pushes harder at times against the foot pedal, the additional stresses generated by such a harder push may be exhibited by a narrowing of a gap between the track 124 and the levitating track end 122. Thus, the additional shocks and jolts generated from a user's exercises may impose minimal mechanical strain on at least some of the components of the exercise machine 100. Thus, the secondary magnetic field may exhibit at least some of the characteristics of a shock absorber.

While the examples depicted in FIGS. 2A and 2B are illustrated with a flat track 124, in other examples the track 124 may have a side wall that assists in guiding the track end 122. In such examples, the gap formed by the levitation of the track end 122 may or may not exceed the height of the side wall. In yet other examples, the track 124 may include an ceiling overhang that prevents the magnetic unit 200 from levitating higher than desired. In such circumstances, the magnets 206 may be positioned on the top side of the housing 202 to create another secondary magnetic field in the ceiling overhang to prevent physical contact between the ceiling overhang and the magnetic unit 200. In additional examples, at least some magnets 206 may be disposed in a side of the magnetic unit's housing 202, which may prevent physical contact between the magnetic unit 200 and a side wall of the track 124.

Figure 3:
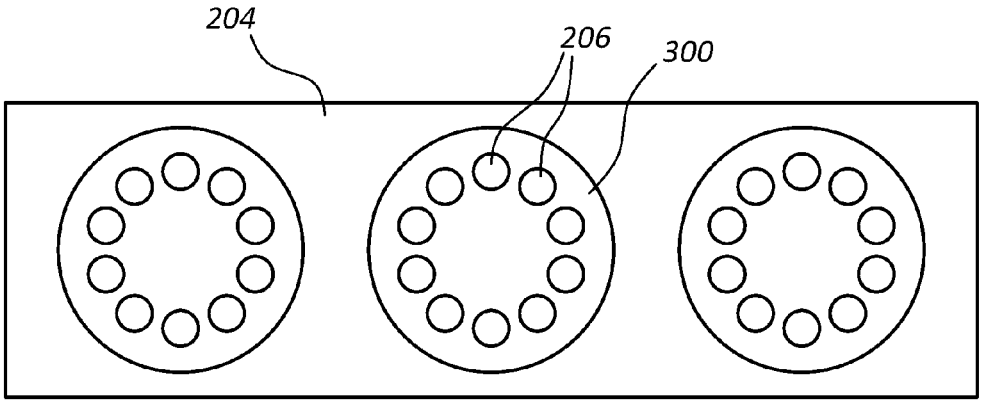
FIG. 3 illustrates a bottom view of an example of an underside of a magnetic unit integrated into the exercise machine in accordance with the present disclosure.

FIG. 3 depicts an alternative example of the housing's underside 204. In this illustrated example, each of the magnets 206 are embedded in a magnetic unit that includes a rotor 300 that can be driven by a motor. In this example, the motor can cause the rotor 300 to rotate and move the magnets 206 independently of the track end 122. As a result, the motor may be driven to cause the track end 122 to levitate without relative movement of the track end 122 caused from the user imparting forces on the foot pedals 106. In some examples, the rotors 300 may be able to cause faster relative movement between the magnets 206 and the non-ferromagnetic material, thereby causing a greater secondary magnetic field, which may create a greater levitation force. In some examples, the speed of the rotors 300 can be adjusted to achieve a desired levitation height or repulsion force. Such speed variations may account for the speed at which the user causes the right and left track ends to move along the right and left tracks.

In some situations, the motor drives the rotation of the rotors 300 when power is supplied to the exercise machine 100. In other examples, the motor is caused to rotate the rotors 300 when instructed by the user. In yet other examples, the rotors 300 are driven in response to detected movement of the foot pedals 106, 108, movement of the arm levers 110, 112, movement of another component of the exercise machine 100, or combinations thereof.

Figure 4:
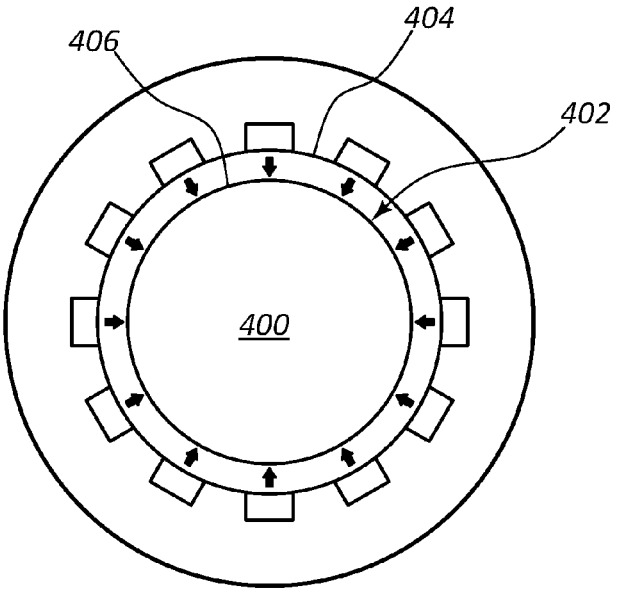
FIG. 4 illustrates a side view of an example of a friction reducing assembly integrated into the exercise machine in accordance with the present disclosure.

The principles described herein about causing magnetically induced levitation or at least reducing friction between exercise machine parts can be applied to other locations on the exercise machine 100 than just the junction between the track ends 122, 134 of the linkages 120, 132 and the tracks 124, 136. For example, these principles may be applied to the right and left resistance ends 118, 130 of the right and left linkages 120, 132. In the example of FIG. 4, an axle 400 protruding from the resistance mechanism 104 is depicted as being inserted between an aperture 402 of the resistance end of one of the right or left linkages 120, 132. In this example, the inside perimeter 404 of the aperture 402 is greater than the outside perimeter 406 of the axle 400 such that a gap exists there between. In this example, magnets 206 are disposed along the inside perimeter 404 of the aperture 402. Also, the axle 400 may be made of a non-ferromagnetic material that exhibits the ability to create a secondary magnetic field in response to exposure of a moving magnetic field as described above. In such examples, when relative movement is caused between the aperture 402 and the axle 400, magnetic fields from the magnets 206 in the inside perimeter 404 of the aperture 402 move through the non-ferromagnetic material of the axle 400 resulting in inducing a secondary magnetic field. In such an example, the secondary magnetic field may repel the magnets 206 in the inside perimeter 404 causing the axle 400 to center within the aperture 402 such that an annular gap between the axle 400 and the inside perimeter 404 is formed. Such an arrangement may reduce the wear and tear conventionally associated with the connections between linkages and the resistance mechanism.

Figure 5A:
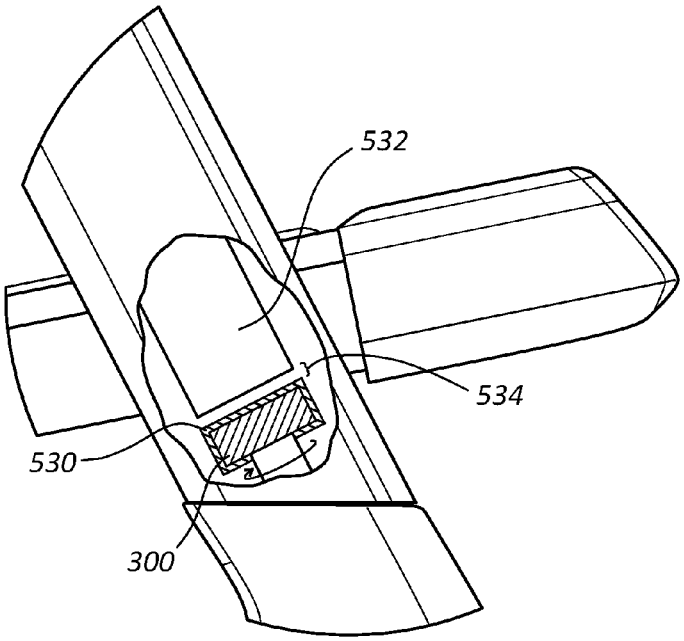
FIG. 5A illustrates a side view of an example of an incline mechanism in a treadmill in accordance with the present disclosure.
Figure 5B:
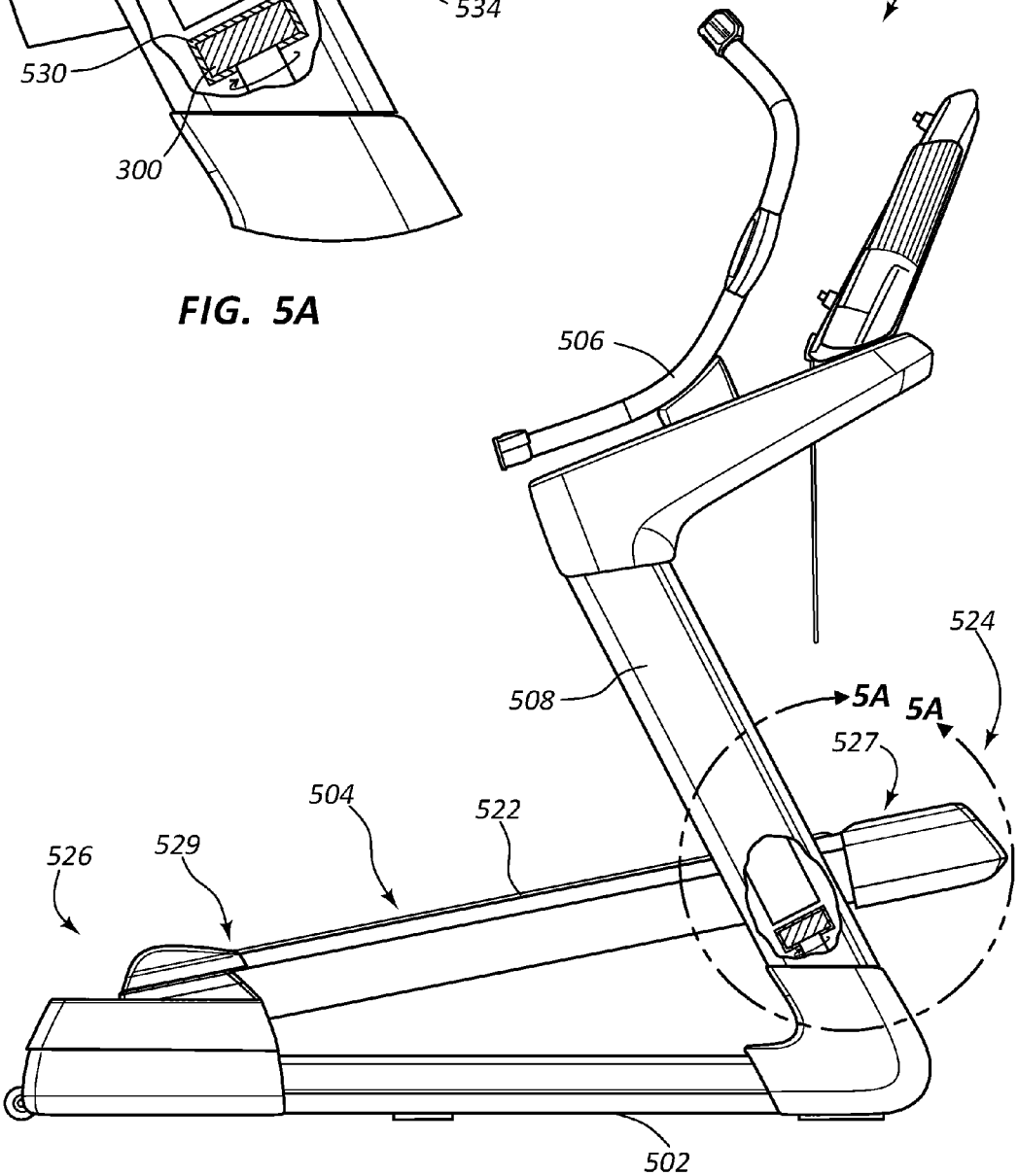
FIG. 5B illustrates a side view of an example of an incline mechanism in a treadmill in accordance with the present disclosure.

FIGS. 5A and 5B illustrate an example of another type of exercise machine, such as a treadmill 500 in accordance with the present disclosure. In this example, the treadmill 500 includes a frame 502, an exercise deck 504, and a pair of arm rests 506.

In this example, the frame 502 has a pair of frame posts 508 connected to the exercise deck 504. The exercise deck 504 includes a tread belt 522 that spans between a front pulley at a front end 524 of the treadmill 500 and a rear pulley at a rear end 526 of the treadmill 500. In some examples, one of the front pulley or the rear pulley is driven by a motor, which causes the tread belt 522 to rotate about the front and rear pulleys. In some examples, a top surface of the tread belt 522 moves from the front pulley to the rear pulley.

An incline mechanism may be used to control the front to rear slope of the exercise deck 504. Any appropriate type of incline mechanism may be used to raise and/or lower either a front section 527 or a rear section 529 of the exercise deck 504. Further, any appropriate type of slope may be achieved with the incline mechanism. In some examples, the front to rear slope of the exercise deck 504 may be oriented at a negative angle where the front section 527 is lower than the rear section 529. In other examples, the front to rear slope angle is between negative 45.0 degrees and positive 45.0 degrees. Further, in some embodiments, the exercise deck 504 is capable of changing its side to side tilt angle.

The incline mechanism may comprise a rotor 300 similar to the rotor depicted in FIG. 4 where magnets 206 are disposed on the face 530 of the rotor 300. In the illustrated example, the rotor 300 is positioned adjacent to a section 532 of the posts 508 that comprises a non-ferromagnetic material. In the illustrated example, the rotor 300 may be moved along the length of the posts 508 to control the front to rear incline of the exercise deck 504. Further, the rotor 300 may be rotated at any position along the length of the posts 508. As the rotor 300 rotates, the magnets' magnetic fields move through the non-ferromagnetic material of the post's section 532 causing the secondary magnetic field to be generated. As a result, the non-ferromagnetic section 532 is levitated away from the rotor 300 which lifts the entire post 508 thereby increasing the incline slope of the exercise deck 504. A gap 534 may be formed between the rotor 300 and the non-ferromagnetic section 532. As the user runs on the exercise deck 504, an additional load may be placed on the exercise deck 504 each time the user's feet impact the exercise deck 504. The magnetic forces causing the non-ferromagnetic section 532 to levitate may exhibit at least some of the characteristics of a shock absorber. However, wear and tear is reduced because there is no physical contact between the non-ferromagnetic section 532 and the rotor 300.

Figure 6:
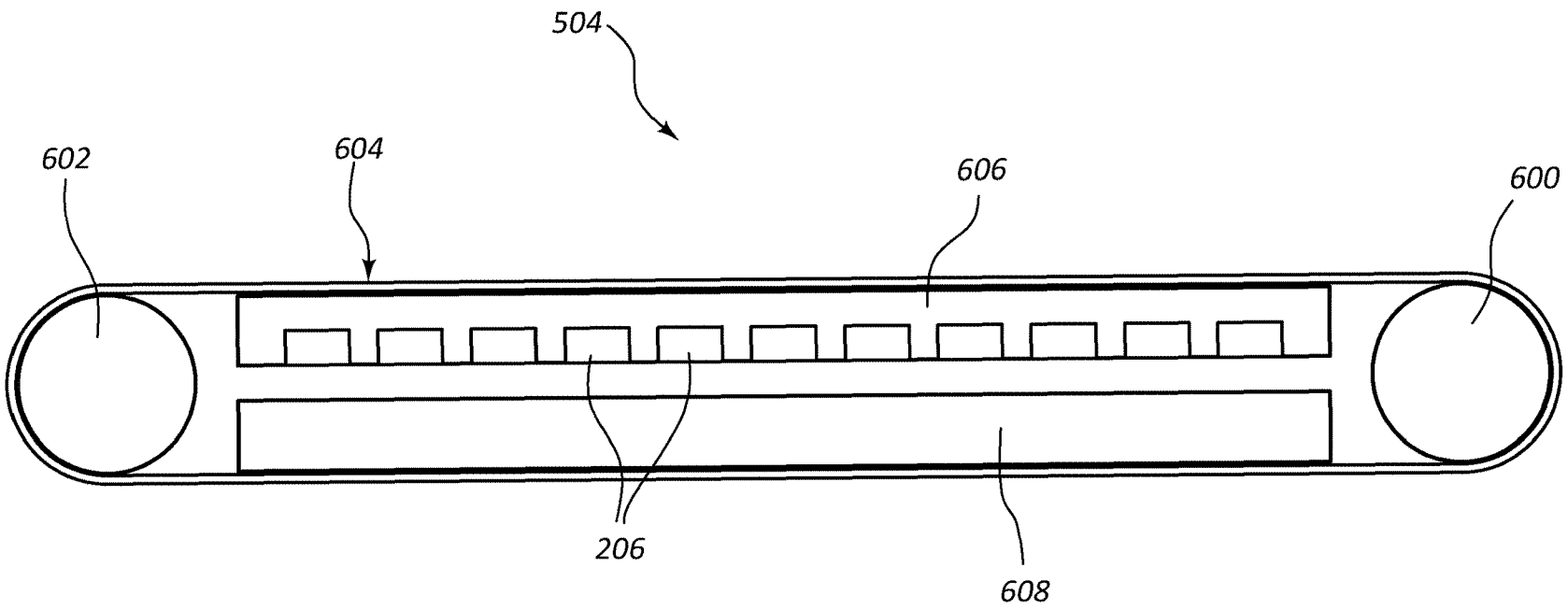
FIG. 6 illustrates a side view of an example of a treadmill deck in accordance with the present disclosure.

FIG. 6 depicts an example of an exercise deck 504 of a treadmill 500. In this example, the tread belt 522 is disposed around a first pulley 600 and a second pulley 602. A platform 604 is disposed between the first and second pulleys 600, 602. In the example of FIG. 6, the platform 604 includes a first portion 606 that is disposed over a second portion 608. The first portion 606 comprises magnets 206 that are capable of moving, such as with a motor, a linear actuator, or another type of actuator. The second portion may comprise a non-ferromagnetic material that is positioned to be exposed to the moving magnetic fields of the magnets 206 as the magnets 206 move relative to the non-ferromagnetic material. As described above, such moving magnetic fields may result in a secondary magnetic field that repels the magnets 206. As a result, the first portion 606 of the platform 604 may levitate over the second portion 608. In such circumstances, when a user exercises on the exercise deck 504, the user's feet may have a varying load on the first portion 606 of the platform 604 as the user's feet impact the tread belt 522 at different times. The load variations may be absorbed by the magnetic fields that cause a gap to form between the first and second portions 606, 608 of the platform 604. Thus, such an exercise deck 504 as described in conjunction with FIG. 6 may exhibit characteristics of a shock absorber between the first and second portions 606, 608 of the platform 604.

Figure 7:
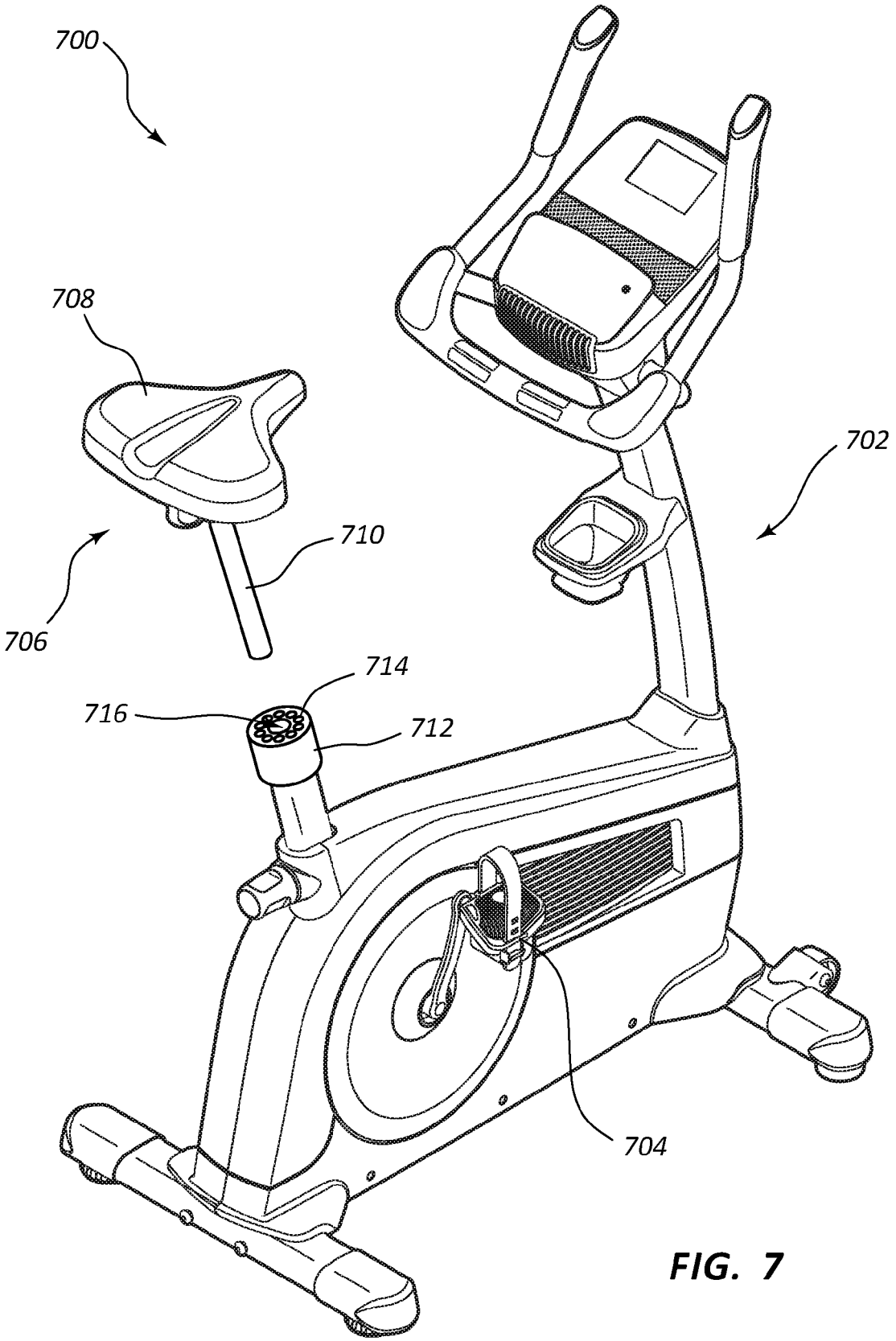
FIG. 7 illustrates an exploded view of an example of a seat of a stationary bike in accordance with the present disclosure.

FIG. 7 depicts a partially exploded view of a stationary bike 700. In this example, the stationary bike comprises a frame 702, an internal resistance mechanism, foot pedals 704, and a seat assembly 706. The seat assembly 706 includes a saddle 708, a seat post 710, a rotor 712 containing multiple magnets 206 embedded in the rotor's face 714, and a seat opening 716. An underside of the saddle 708 is connected to the seat post 710 which is received within the seat opening 716. The rotor 712 is disposed within the seat opening 716 such that the rotor's face 714 is adjacent to the seat post 710. The seat post 710 may comprise a non-ferromagnetic material that is positioned to be exposed to the moving magnetic fields from the rotor's face 714 as the rotor 712 rotates. In such circumstances, the seat post 710 may be subjected to a force that pushes the seat post 710 upward within the seat opening 716. As a user sits on the saddle 708, the user may vary the amount of load he or she places on the saddle 708. Magnetic forces pushing against the load applied by the user may exhibit at least some of the characteristics of a shock absorber within the seat assembly 706.

In some examples of a seat assembly 706, a motor or another type of actuator which causes the rotor 712 to rotate is activated in response to detecting that a user is sitting on the saddle 708. In other examples, the motor is activated in response to detecting that the foot pedals 704 are moving. In yet another example, the motor is activated in response to commands inputted into the exercise machine 100 by the user. While the seat assembly 706 has been described with specific mechanisms for triggering the rotor 712 to rotate, any appropriate mechanism for triggering the rotation of the rotor 712 may be used in accordance with the principles described in the present disclosure.

Figure 8:
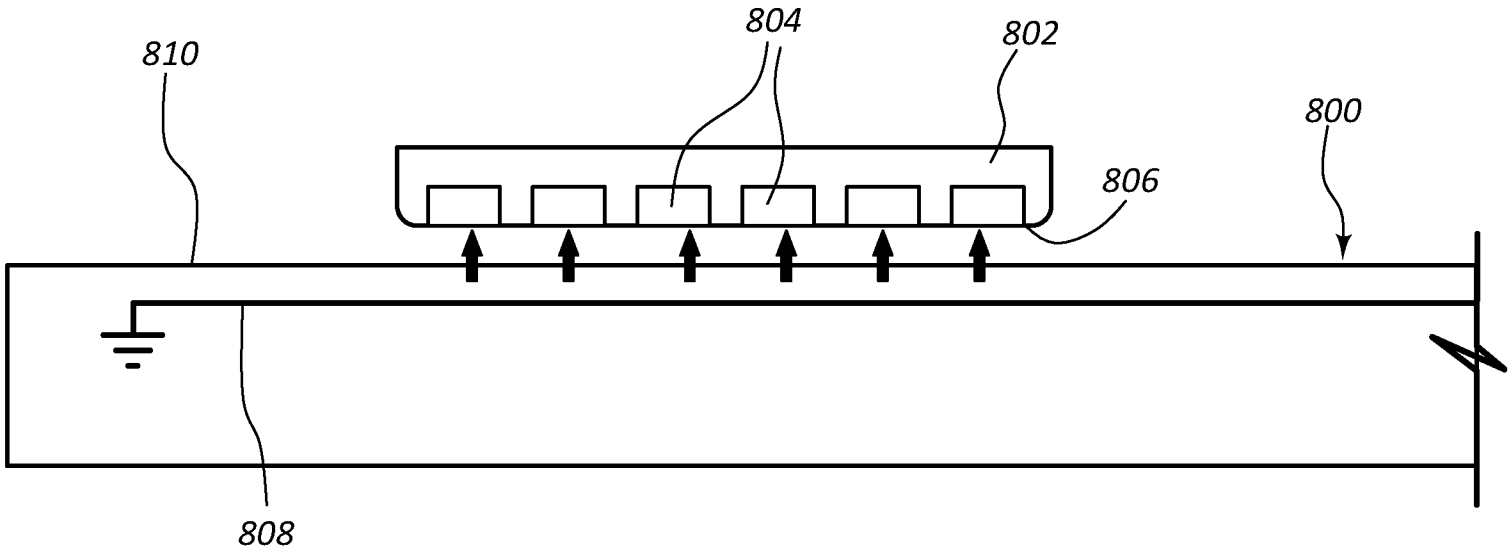
FIG. 8 illustrates a side view of an example of a track in an exercise machine in accordance with the present disclosure.

FIG. 8 depicts a track 800 and a foot pedal 802. In this illustrated example, magnets 804 are disposed on the underside 806 of the foot pedal such that the magnets 804 direct a magnetic field towards the track 800. Such a track 800 and foot pedal 802 may be part of an exercise machine 100 constructed to simulate a cross country skiing motion. As such, the foot pedal 802 may slide along a length of the track 800.

The track 800 may be made of a non-ferromagnetic material such that a secondary magnetic field is generated as the foot pedal 802 moves along the track 800. In this illustrated example, the track 800 also includes an electrical conductor 808 that is embedded into the track and is adjacent to the track's surface 810. Such an electrical conductor 808 may be electrically grounded to the track 800 or another appropriate component of the exercise machine 100. The electrical conductor 808 may carry an alternating current from any appropriate source. In one example, the exercise machine can be plugged into the alternating electrical current source used by the home or building in which the exercise machine 100 resides. As the alternating current changes polarity, the electrical and magnetic characteristics of the electrical conductor may generate a secondary magnetic field that exhibits the characteristics of magnetically repelling the magnets 804 in the foot pedal 802. Thus, the foot pedal 802 may be caused to levitate or at least friction may be reduced in response to causing the electrical conductor 808 to carry the alternating current.

In some examples of such a track 800 and foot pedal 802 arrangement, the electrical conductor 808 may be caused to carry the alternating current in response to sensing the user's weight on the foot pedal 802. In other examples, the electrical conductor 808 is caused to carry the alternating current in response to detecting relative movement between the foot pedal 802 and the track 800. In yet another example, the electrical conductor 808 is caused to carry the alternating current in response to commands inputted into the exercise machine 100 by the user. While the arrangement depicted in FIG. 8 has been described with specific mechanisms for causing the electrical conductor 808 to carry alternating current, any appropriate mechanism for causing the electrical conductor 808 to carry alternating current may be used in accordance with the principles described in the present disclosure.

While the examples above have described friction reducing assemblies with two portions where the first portions contains permanent magnets and the second portion contains a non-ferromagnetic material, in other examples, the magnets are embedded in the second portion and the non-ferromagnetic material is integrated into the first portion. Also, the examples above have been described with either the first portion or the second portion having a non-ferromagnetic portion. In some cases, the entire structure of the portions are made of the non-ferromagnetic material. In other examples, a coating of non-ferromagnetic material is applied to the appropriate structures of the first and second portions.

While the examples above have described the arrangement of the magnets and the non-ferromagnetic material being used to absorb shocks, to reduce wear, to separate components of the exercise machine, or to reduce friction, the arrangement may be used for any appropriate functions. The arrangement may be incorporated into incline mechanisms, side to side tilt mechanisms, shock absorbers, skier tracks, other types of tracks, seat assemblies, crankshaft assemblies, foot pedal assemblies, pulley mechanisms, arm lever mechanisms, other types of assemblies of an exercise machine, mechanical linkages, or combinations thereof.

The relative movement between the magnets 206 and the non-ferromagnetic material may be at any appropriate speed. In some examples, the speeds that cause the desired levitation effect are over 0.5 miles per hour. In examples where the magnets 206 are disposed on rotors 300, the rotors 300 may be caused to spin between 1.0 to 500.0 revolutions per minute.

Additionally, any appropriate type of magnet may be used to create the desired levitation or friction reducing effect. For example, the magnets may be permanent magnets. In other examples, the magnets are electromagnets. A non-exhaustive list of the magnets' materials may include iron, ferrite, nickel, cobalt, rare earth metals, lodestone, other minerals, other elements, alloys thereof, mixtures thereof, composites thereof, or combinations thereof.

Figure 9:
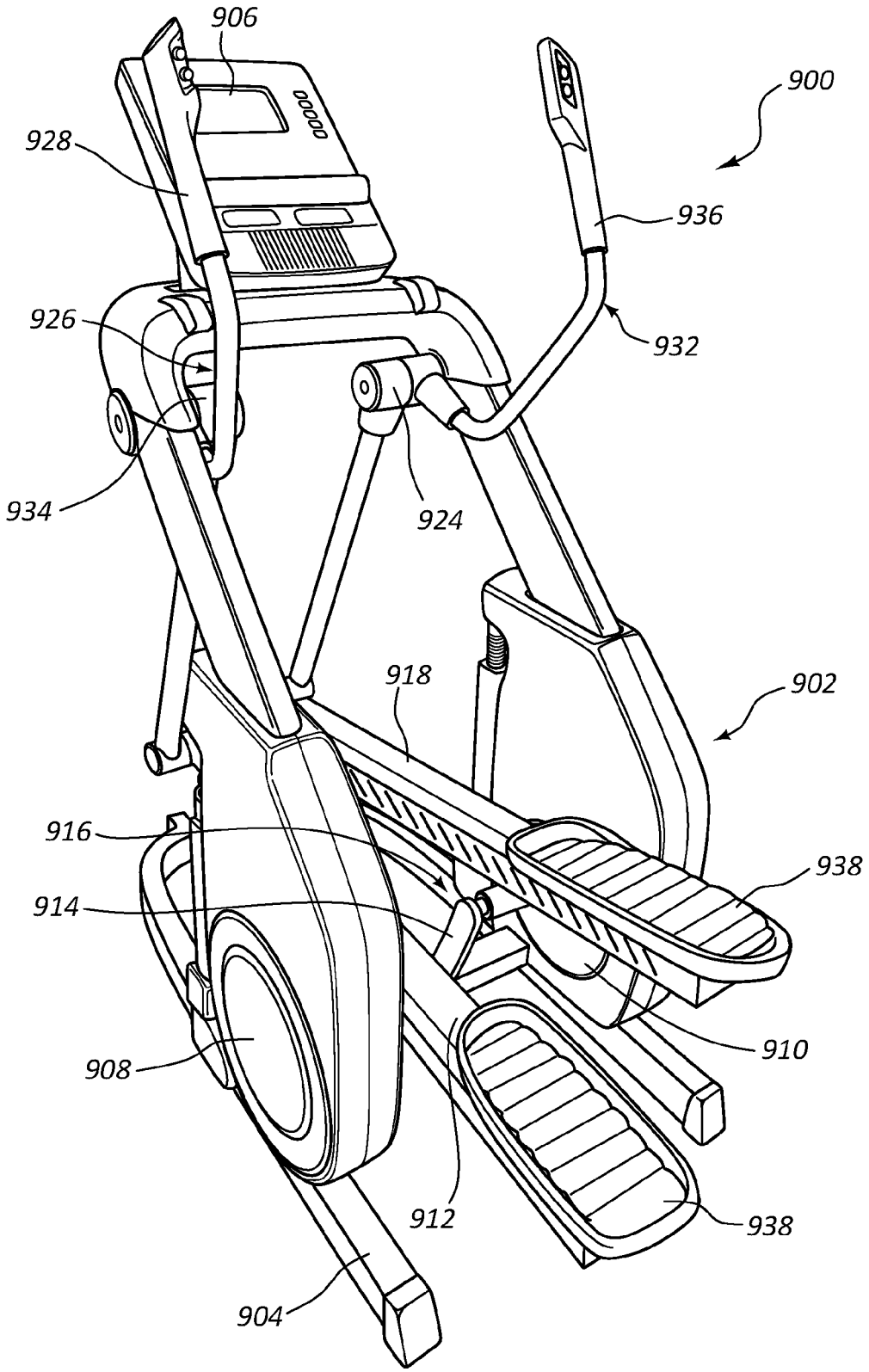
FIG. 9 illustrates a perspective view of an example of an exercise machine in accordance with the present disclosure.
Figure 10:
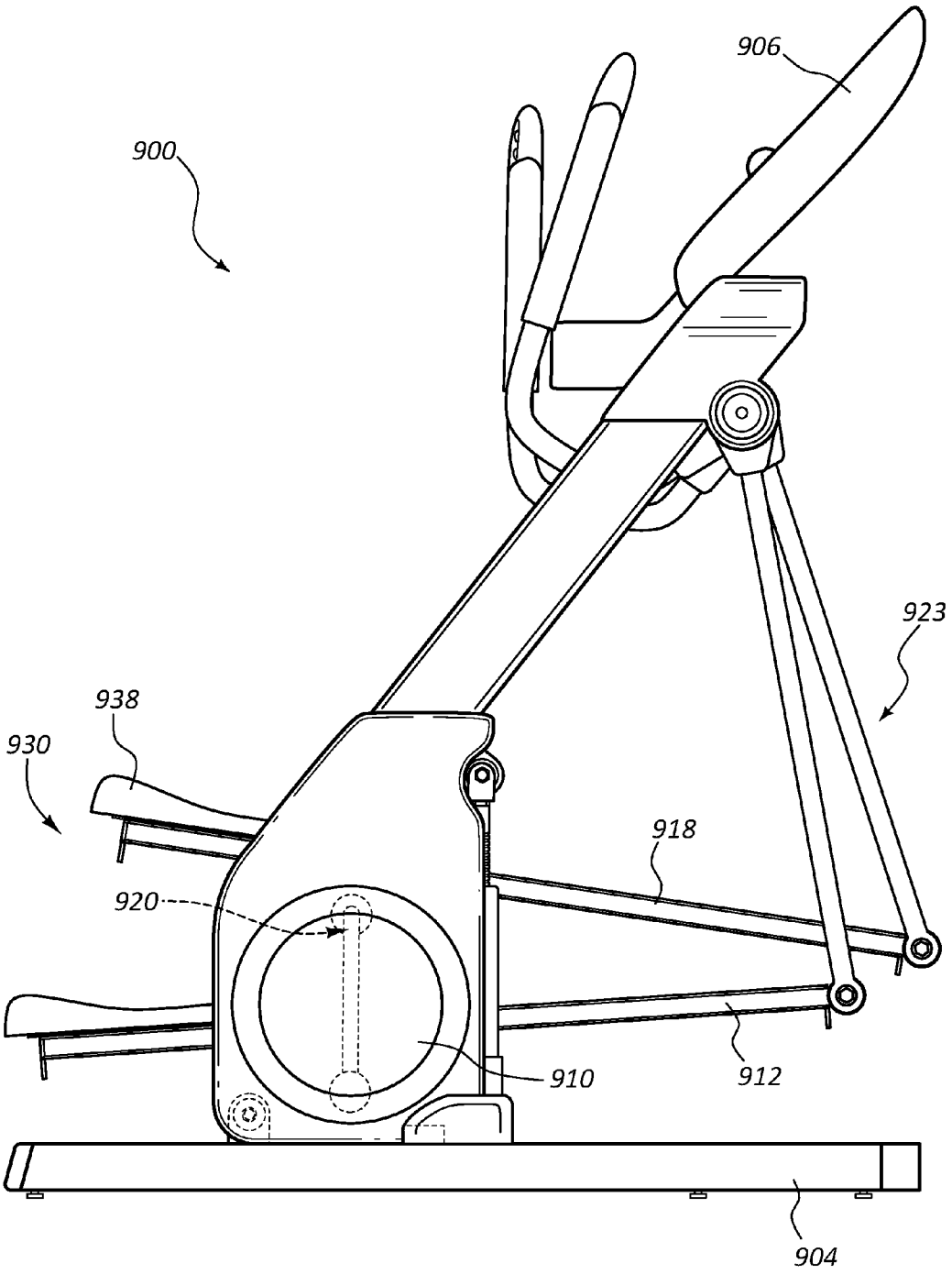
FIG. 10 illustrates a side view of an example of an exercise machine in accordance with the present disclosure.

FIGS. 9 and 10 depict an exercise machine 900. In this example, the exercise machine 900 is an elliptical trainer exercise machine. The exercise machine 900 includes a frame 902 attached to a base 904. A console 906 is connected to the frame 902 at a different end from the base 904. The frame 902 incorporates a first flywheel 908 and a second flywheel 910. The first flywheel 908 is connected to a first foot beam 912 through a first crank arm 914 of a crank assembly 916. The second flywheel 910 is connected to a second foot beam 918 through a second crank arm 920 of the crank assembly 916. The crank arms 914, 920 slidably contact the underside of the first and second foot beams 912, 918 such that the location of contact between the undersides and the heads of the crank arms 914, 920 changes as the first and second foot beams 912, 918 move.

A front end 923 of the first foot beam 912 is connected to a first arm lever 924 that connects to the frame 902 at a first pivot connection 926. The first pivot connection 926 is also attached to a first handle section 928 which is accessible to the user as the user is using the exercise machine 900. A second end 930 of the second foot beam 918 is connected to a second arm lever 932 that connects to the frame 902 at a second pivot connection 934. The second pivot connection 934 is also attached to a second handle section 936 which is also accessible to the user as the user is using the exercise machine 900. As the first and second foot beams 912, 918 move, the first and second handle sections 928, 936 move accordingly.

Each of the first and second foot beams 912, 918 have a foot pedal 938 in which a user can stand with his or her foot to cause the foot beams 912, 918, and thereby the handle sections 928, 936, to move. As the foot beams 912, 918 move, the heads of the first and second crank arms 914, 920 slidably move along the length of the foot beams' underside.

In some examples, the underside comprises a non-ferromagnetic material, and the heads of the crank arms 914, 920 incorporate a magnet. As the foot beams 912, 918 move with respect to the crank arms 914, 920, a secondary magnetic field may be generated that repels the magnets, and therefore, the heads of the crank arms 914, 920 away from the underside 922 of the foot beams 912, 918.

In other examples, the magnets are disposed within a face of a rotor that is incorporated into a face of a rotor. As the rotor turns, the magnet may move with respect to the foot beam underside and thereby generates the secondary magnetic field. While the secondary magnetic field generates a force to repel the undersides away from the crank arm heads, such a repulsion force may not be strong enough to cause a separation between the crank arm heads and the foot beam underside. However, such a force may be sufficient to reduce the friction between the crank arm heads and the foot beam undersides.

Rails 940 may be integrated into the undersides of the first and foot beams 912, 918. In such an example, if the repulsion force from the secondary magnetic field were to cause the crank arm heads to separate from the undersides of the foot beams, the rails 940 may keep the crank arms aligned and from completely becoming unattached. In such an example, the friction between the undersides and the crank arm heads may be significantly reduced and/or eliminated.

Figure 11A:
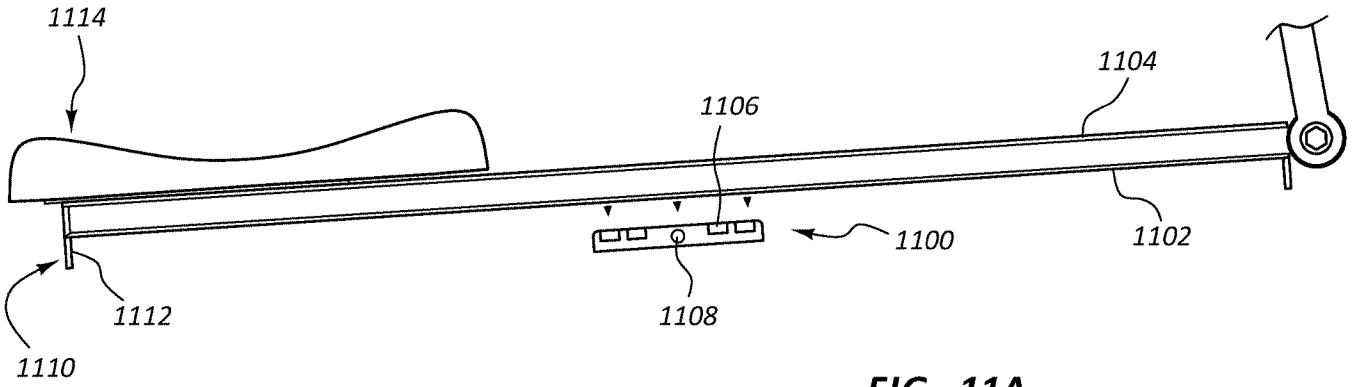
FIG. 11A illustrates an example of a friction reducing assembly incorporated into a foot beam in accordance with the present disclosure.
Figure 11B:
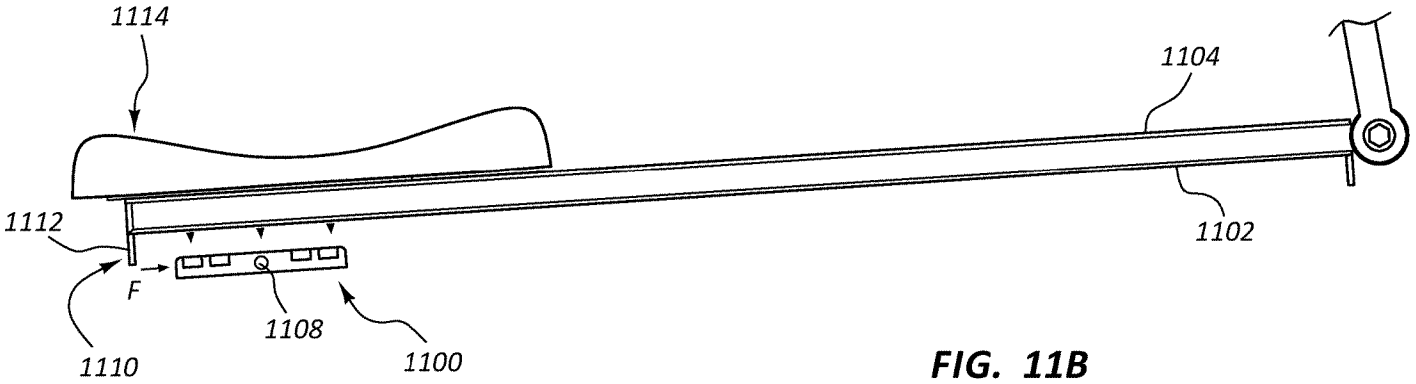
FIG. 11B illustrates an example of a friction reducing assembly incorporated into a foot beam in accordance with the present disclosure.

FIGS. 11A and 11B depict a head 1100 of a crank arm slidably arranged with the underside 1102 of a foot beam 1104. The head 1100 comprises multiple rotors 1106 with at least one magnet disposed within the rotor's face. However, in some examples, multiple magnets can be incorporated into the rotor's face, such as in FIG. 3. In some situations, as the rotors spin, the magnetic field of the magnets moves with respect to the non-ferromagnetic material of the foot beam 1104. Such movement of the magnetic field relative to the non-ferromagnetic field induces the secondary magnetic field that applies a force to repel the foot beam 1104 away from the head 1100 of the crank arm. In such an example where a rotor in the head 1100 moves the magnets, the head 1100 of the crank arm does not have to move relative to the foot beam 1104 to induce the secondary magnetic field and thereby reduce the friction between the head 1100 and the underside 1102 of the foot beam 1104. Thus, with the rotors activated, the head 1100 can move along the length of the underside 1102 with reduced or no mechanical friction between the head 1100 and the underside 1102.

The power to rotate the rotors may come from a power source that is located within the head 1100. In other examples, a battery pack may be incorporated into the crank arm head 1100. Also, power may be delivered to the head 1100 from a remote location. In such an example, the crank arm may include an electrically conductive medium, such as a wire, cable, or other type of electrically conductive medium, to carry electrical power to the rotors in the head 1100. In such an example, the power source may be located in the crank arm or elsewhere on the exercise machine.

The head 1100 may be connected to the crank arm through a pivot joint 1108. In examples where the crank arm incorporates an electrically conductive medium for providing power to the head 1100, the power may be transferred to the head 1100 through the pivot joint 1108. For example, a brush may be incorporated into the pivot joint 1108 to transfer the electrical power to the head. In some examples, the brush includes mechanical bristles made of electrically conductive material that bridges the gap between the head's body and the pivot axle of the joint 1108. In other examples, the brush induces a magnetic field through the pivot joint's gap to transfer power between the head 1100 and the crank arm. In yet other examples, a flexible wire or other type of electrically conductive medium may be secured to the head 1100 at a first end and to the crank arm at a second end. In such an example, the flexible wire may bend as the head 1100 pivots relative to the crank arm thereby keeping the crank arm and head 1100 in electrical communication during the relative movement of head 1100 and the crank arm.

In some situations, the magnetic field provided by the magnets disposed in the face of the crank arm head 1100 extend far enough to create secondary magnetic fields in more components of the exercise machine than just the underside 1102 of the foot beam 1104. For example, the magnetic field may induce a secondary magnetic field in a deceleration mechanism 1110 also attached to the foot beam 1104. In FIGS. 11A and 11B, the deceleration mechanism 1110 includes a protruding member 1112 that extends beyond the foot beam's underside 1102. Additionally, the protruding member 1112 is located at an end 1114 of the foot beam 1104. The protruding member 1112 includes a non-ferromagnetic material. In such examples, the orientation of the protruding member 1112 and the orientation of the original magnetic field from the crank arm head 1100 are oriented such that a secondary magnetic field is also generated in the protruding member 1112. The protruding member's secondary magnetic field may also direct a repulsive force towards the approaching head 1100 of the crank arm thereby decelerating the speed at which the head 1100 approaches the end 1114 of the foot beam 1104. This increased amount of resistance may cause the head 1100 to come to a stop short of contacting the protruding member 1112. By preventing contact between the protruding member 1112 and the head 1100, the head 1100 is prevented from disconnecting with the foot beam 1104. Further, a mechanical stop to prevent the head 1100 from traveling off of the foot beam 1104 may create an abrupt change in speed which may be undesirable for the user and the life of the exercise machine's components.

In some situations, magnets, magnets in rotors, or other arrangements may be incorporated into the approaching side of the head 1100. In such an example, the magnets in the head's side and the magnets in the head's face may be constructed to exhibit different magnetic strengths, different magnetic field directions, and/or other different magnetic properties to create secondary magnetic fields according to the principles described in the present disclosure.

Figure 12:
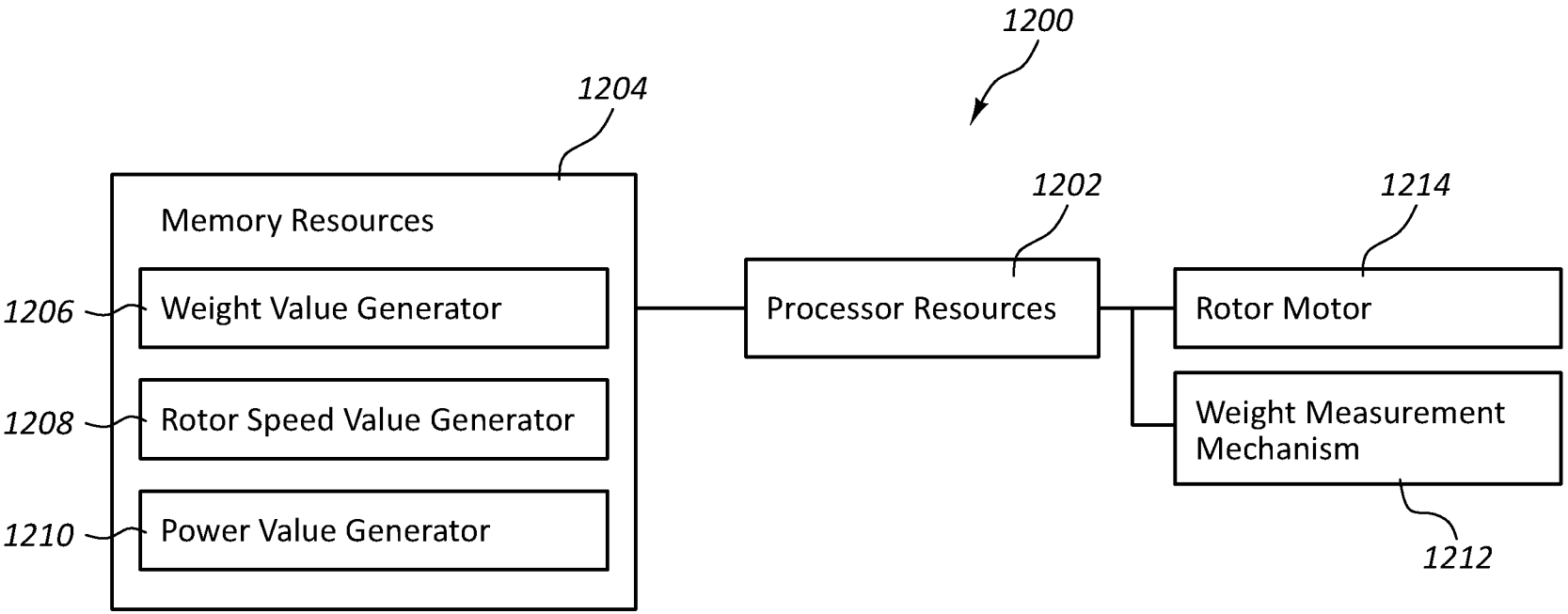
FIG. 12 illustrates a block diagram of an example of a friction reducing system in accordance with the present disclosure.

FIG. 12 illustrates a perspective view of an example of an friction reducing system 1200 in accordance with the present disclosure. The friction reducing system 1200 may include a combination of hardware and programmed instructions for executing the functions of the friction reducing system 119. In this example, the friction reducing system 1200 includes processing resources 1202 that are in communication with memory resources 1204. Processing resources 1202 include at least one processor and other resources used to process the programmed instructions. The memory resources 1204 represent generally any memory capable of storing data such as programmed instructions or data structures used by the friction reducing system 1200. The programmed instructions and data structures shown stored in the memory resources 1204 include a weight value generator 1206, a rotor speed value generator 1208, and a power value generator 1210.

The memory resources 1204 include a computer readable storage medium that contains computer readable program code to cause tasks to be executed by the processing resources 1202. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory or combinations thereof.

The weight value generator 1206 represents programmed instructions that, when executed, cause the processing resources 1202 to generate a value that represents the weight of a user. The weight value generator 1206 may be instructed to determine the value in response to a person getting onto the exercise machine. For example, a weight measurement mechanism 1212, such as a load cell incorporated into the foot pedals or another location of the exercise machine, may provide measurements to assist in generating the weight value. In other examples, the user may input his or her weight into the console of the exercise machine, and the weight value generator 1206 may use the user's input to generate the value. In yet further examples, the processor may be in communication with a user profile that contains a user weight. Such a user profile may be part of a social media network, a private website, a fitness tracking program, or another type of program. A fitness tracking program that may be compatible with the principles described in the present disclosure can be found at www.ifit.com, which is operated by ICON Health and Fitness headquartered in Logan, Utah, U.S.A. In other examples, strain gauges or the power consumption of a motor of the exercise machine may be used as factors for generating the weight value.

The rotor speed value generator 1208 represents programmed instructions that, when executed, cause the processing resources 1202 to generate a value of a speed to rotate the rotors. In such an example, the rotors have at least one magnet incorporated into their rotor face. The rotational speed of the rotor may determine, at least in part, the strength of the secondary magnetic fields. Since some users have different weight, the strength of the secondary magnetic fields may be varied to create the appropriate strength for the secondary magnetic field. In some instances, a first strength of a secondary magnetic field may be appropriate for a first user with a heavy weight, while the same strength may cause undesirable effect for users with less weight.

The power value generator 1210 represents programmed instructions that, when executed, cause the processing resources 1202 to generate a value of power to apply to the rotor motor 1214. The power value may be based entirely or just in part on the rotor speed value generated by the rotor speed value generator 1208.

Further, the memory resources 1204 may be part of an installation package. In response to installing the installation package, the programmed instructions of the memory resources 1204 may be downloaded from the installation package's source, such as a portable medium, a server, a remote network location, another location or combinations thereof. Portable memory media that are compatible with the principles described herein include DVDs, CDs, flash memory, portable disks, magnetic disks, optical disks, other forms of portable memory or combinations thereof. In other examples, the program instructions are already installed. Here, the memory resources 1204 can include integrated memory such as a hard drive, a solid state hard drive or the like.

In some examples, the processing resources 1202 and the memory resources 1204 are located within the exercise machine, a mobile device, an external device, another type of device, or combinations thereof. The memory resources 1204 may be part of any of these device's main memory, caches, registers, non-volatile memory or elsewhere in their memory hierarchy. Alternatively, the memory resources 1204 may be in communication with the processing resources 1202 over a network. Further, data structures, such as libraries or databases containing user and/or workout information, may be accessed from a remote location over a network connection while the programmed instructions are located locally. Thus, the friction reducing system 1200 may be implemented with the mobile device, console, the exercise machine, a phone, an electronic tablet, a wearable computing device, a head mounted device, a server, a collection of servers, a networked device, a watch, or combinations thereof. Such an implementation may occur through input/output mechanisms, such as push buttons, touch screen buttons, voice commands, dials, levers, other types of input/output mechanisms or combinations thereof.

INDUSTRIAL APPLICABILITY

In general, the invention disclosed herein may provide the user with an exercise machine that experiences minimal amounts of wear and tear for at least some of the components of the exercise machine. The reduced or eliminated wear and tear may be accomplished by incorporating magnets into a first component of the exercise machine and incorporating a non-ferromagnetic material into a second, adjacent component of the exercise machine where the second component can move relative to the first component. The characteristics of magnetic fields from the magnets and the non-ferromagnetic material may cause the generation of a secondary magnetic field in the non-ferromagnetic material. The secondary magnetic field may oppose the original magnetic field from the magnets creating opposing magnetic forces that repel one another. Such opposing magnetic forces may cause one of the components to levitate over the other component. In other examples, the opposing magnetic forces may prevent the components from contacting one another.

The non-contact intersections between the first and second components may aid in allowing the components to move in relation to each other without making physical contact. Without physical contact, the components may experience a reduced amount of wear at the intersection of the two components. In some cases, the wear between the two components may be completely eliminated. Conventional exercise machines may be constructed such that joints that are prone to wear are reinforced with specialized materials to form bearing surfaces to reduce wear. In some circumstances, owners of such exercise machines with such prone joints may be instructed to maintain the exercise machine by periodically greasing the joints. With the principles described in the present disclosure, the prone wear joints may be made with a non-ferromagnetic material and magnets to prevent and/or eliminate the wear. Thus, the owners may not need to grease such joints or perform other types of maintenance tasks to preserve such joints.

The relative movement between the non-ferromagnetic material and the magnets may be induced when the user causes the movable element of the exercise machine to move. For example, the user may cause the foot pedals of an elliptical exercise machine to move and either the non-ferromagnetic material or the magnets may move with the foot pedal. Such movement may cause the non-ferromagnetic material and the magnets to move relative to each other, but still within a proximity of one another such that the magnetic fields of the magnets pass through the non-ferromagnetic material. Thus, the separation of the components may be inherently caused from the movement induced manually by the user.

In other examples, the relative movement between the non-ferromagnetic material and the magnets occurs independently of the movement manually induced by the user. In such examples, the magnets may be incorporated into a rotor or a linear actuator that causes the magnets to move relative to the non-ferromagnetic material. Thus, the separation and/or levitation of the components may occur prior to the user manually moving a movable element of the exercise machine. In other examples, the exercise machine may detect when the user is in the process of using the exercise machine or is about to use the exercise machine. In such examples, the exercise machine may cause the rotor or linear actuator to move to create the desired separation, levitation, and/or reduced friction effect.

In examples where the magnets are incorporated into a rotor, the rotor may move the magnets along a circular track defined by the motion of the rotor. In examples where the magnets are incorporated into a linear actuator, the magnets may be moved along a linear track defined by the movement of the linear actuator. Likewise, in those examples where the magnets follow a track incorporated into the exercise machine, the resulting secondary magnetic field may cause the other magnets to move in a linear direction, a curved direction, or another type of direction which are defined by the shape of the tracks.

In other examples, the levitation effect may occur based on the changing polarity of an electric alternating current in the non-ferromagnetic material. For example, an alternating electrical current may be carried by an electrical conductor embedded into the non-ferromagnetic material. As the polarity of the electrical current switches, the effects of creating a secondary magnetic field may be exhibited in the non-ferromagnetic material. Such a secondary magnetic field may cause the magnets to move away from the non-ferromagnetic material thereby forming a gap between the component with the magnets and the component with the non-ferromagnetic material.

In some examples, the exercise machine is an elliptical trainer exercise machine. Such an exercise machine may include a first flywheel and a second flywheel that are connected to a first foot beam through a first crank arm of a crank assembly and a second foot beam through a second crank arm respectively. The crank arms may slidably contact the underside of the foot beams such that the locations of contact between the undersides and the heads of the crank arms change as the first and second foot beams move. As the foot beams move, the heads of the first and second crank arms slidably move along the length of the underside.

The underside of the foot beams may comprise a non-ferromagnetic material, and the heads of the crank arms may incorporate a magnet. As the foot beams move with respect to the crank arms, a secondary magnetic field may be generated that repels the magnets, and therefore the heads of the crank arms, away from the foot beams.

In other examples, the magnets of the crank arm heads may be incorporated into a face of a rotor. As the rotor turns, the magnet may move with respect to the foot beam and thereby generate the secondary magnetic field. While the secondary magnetic field generates a force to repel the undersides away from the crank arm heads, such a repulsion force may not be strong enough to cause a separation between the crank arm heads and the foot beam undersides. However, such a force may be sufficient to reduce the friction between the crank arm heads and the foot beam undersides. In examples where a rotor in the head moves the magnets, the crank arm's head may not have to move relative to the foot beam to induce the secondary magnetic field and thereby reduce the friction between the head and the foot beam. Thus, with the rotors activated, the head can move along the length of the underside with reduced or no mechanical friction between the head and the underside.

The power to rotate the rotors may come from a power source that is located within the head, such as a battery pack. In other examples, the power may be delivered to the head from a remote location. In such examples the crank arm may include an electrically conductive medium to carry electrical power to the rotors in the head. The head may be connected to the crank arm through a pivot joint through which power can be transferred to the head. For example, a brush may be incorporated into the pivot joint to transfer the electrical power to the head. In yet other examples, a flexible wire or other type of electrically conductive medium may be secured to the head at a first end and to the crank arm at a second end. In such an example, the flexible wire may bend as the head pivots relative to the crank arm thereby keeping the crank arm and head in electrical communication during the operating of the exercise machine.

A deceleration mechanism may be incorporated into the exercise machine to cause the head of the crank arm to decelerate as the head approaches an end of the foot beam. In some examples, the protruding member extends beyond the foot beam's underside and is located at an end of the foot beam. The protruding member includes a non-ferromagnetic material, and the orientation of the protruding member and the orientation of the original magnetic field from the crank arm head are oriented such that a secondary magnetic field is also generated in the protruding member. The protruding member's secondary magnetic field may also direct a repulsive force towards the approaching crank arm head thereby decelerating the speed at which the head approaches the foot beam's end. This increased amount of resistance may cause the head to come to a stop short of contacting the protruding member. By preventing contact between the protruding member and the head, the head is prevented from disconnecting from the foot beam. Further, a mechanical stop to prevent the head from traveling off of the foot beam may create an abrupt change in speed which may be undesirable for the user and the life of the exercise machine's components.

A processor and memory may control the friction reducing components of the exercise machine. The programmed instructions stored in the memory may include a weight value generator, a rotor speed value generator, and a power value generator. The weight value generator may cause the processor to generate a value that represents the weight of a user, which may occur when a user gets onto the exercise machine. In other examples, the user may input his or her weight into the exercise machine or another device. A rotor speed value to rotate the rotors and a power value to apply to the rotor motor may be based, at least in part, on the weight of the user. Since some users' have different weights than other users, the strength of the secondary magnetic fields may be customized to create the appropriate strength for each user.

What is claimed is:

1. An exercise machine, comprising:
a frame;
a movable element movably attached to the frame, the movable element configured to move with respect to the frame during a user's performance of an exercise on the exercise machine and configured to support a weight of the user during the user's performance of the exercise on the exercise machine; and
a friction reducing assembly with a first part attached to the movable element, the friction reducing assembly comprising:
a non-ferromagnetic material; and
a magnet that is configured to move relative to the non-ferromagnetic material as the movable element moves;
wherein relative movement of the non-ferromagnetic material and the magnet is configured to cause the non-ferromagnetic material to create a secondary magnetic field that reduces friction between the non-ferromagnetic material and the magnet.

2. The exercise machine of claim 1, wherein the movable element is a foot beam and a foot pedal is connected to the foot beam.

3. The exercise machine of claim 2, wherein the foot beam comprises the non-ferromagnetic material.

4. The exercise machine of claim 2, further comprising a second part of the friction reducing assembly attached on the exercise machine, wherein the second part of the friction reducing assembly is integrated into the foot beam.

5. The exercise machine of claim 2, further comprising:
a head of a crank arm slidably attached to an underside of the foot beam.

6. The exercise machine of claim 5, wherein the foot beam is configured to move relative to the head of the crank arm when the foot beam is moving in a reciprocating motion.

7. The exercise machine of claim 5, further comprising:
a rail attached to the underside of the foot beam.

8. The exercise machine of claim 5, further comprising:
a deceleration mechanism attached to an end of the underside of the foot beam and configured to cause the head of the crank arm to decelerate when the head slidably approaches the end.

9. The exercise machine of claim 5, further comprising an electric power source electrically connected to the head of the crank arm.

10. The exercise machine of claim 9, further comprising a rotary pivot configured to connect the head of the crank arm to the electric power source.

11. The exercise machine of claim 1, further comprising:
a rotor that holds the magnet;
wherein a face of the magnet in the rotor is exposed.

12. The exercise machine of claim 11, further comprising:
a processor and memory, the memory comprising programmed instructions configured to cause the processor to generate a weight value representative of the weight of the user supported by the exercise machine.

13. The exercise machine of claim 12, wherein the programmed instructions further to cause the processor to rotate the rotor at a speed based at least in part on the weight value.

14. An exercise machine, comprising:
a friction reducing assembly, the friction reducing assembly including:
a non-ferromagnetic material; and
a magnet configured to move relative to the non-ferromagnetic material;
a rotor configured to cause the magnet to move as the rotor rotates, the magnet incorporated into the rotor; and
a processor and memory, the memory comprising programmed instructions configured to cause the processor to:
generate a weight value representative of a weight of a user supported by the exercise machine; and
rotate the rotor at a speed based at least in part on the weight value;
wherein relative movement of the non-ferromagnetic material and the magnet is configured to generate a magnetic force that reduces friction between the non-ferromagnetic material and the magnet.

15. The exercise machine of claim 14, further comprising:
a foot beam; and
a foot pedal connected to the foot beam.

16. The exercise machine of claim 15, wherein the foot beam comprises the non-ferromagnetic material.

17. The exercise machine of claim 15, further comprising:
a crank arm; and
a rotary joint between the foot beam and the crank arm;

wherein the foot beam is in communication with an electric power source through the rotary joint.

18. The exercise machine of claim 15, further comprising:

a head of a crank arm slidably attached to an underside of the foot beam, the foot beam configured to move relative to the head of the crank arm when the foot beam is moving in a reciprocating motion; and a deceleration mechanism attached to an end of the underside of the foot beam and configured to cause the head of the crank arm to decelerate as the head slidably approaches the end of the underside.

19. An exercise machine, comprising:

a frame;

a foot beam movably attached to the frame, the foot beam configured to move with respect to the frame during a user's performance of an exercise on the exercise machine, the foot beam configured to support a weight of the user during the user's performance of the exercise on the exercise machine, the foot beam configured to be in communication with an electric power source through a pivot joint; and a friction reducing assembly comprising:

a non-ferromagnetic material incorporated into the foot beam;

a crank arm in slidable contact with an underside of the foot beam;

a rotor with at least one magnet incorporated into a head of the crank arm, the rotor configured to cause the at least one magnet to move with respect to the underside of the foot beam as the rotor rotates;

a rail attached to the underside of the foot beam;

a deceleration mechanism attached to an end of the underside of the foot beam and configured to cause the head of the crank arm to magnetically decelerate as the head slidably approaches the end; and a processor and memory, the memory comprising programmed instructions configured to cause the processor to:

generate a weight value representative of the weight of the user supported by the exercise machine; and rotate the rotor at a speed based at least in part on the weight value;

wherein relative movement of the non-ferromagnetic material and the magnet is configured to generate a force that reduces friction between the non-ferromagnetic material and the magnet.

20. The exercise machine of claim 19, further comprising:

a weight measurement mechanism configured to provide, in response to the user getting onto the exercise machine, measurements of the weight of the user supported by the exercise machine for use in generation of the weight value.

* * * * *